US012239172B2

(12) United States Patent
Furuta

(10) Patent No.: US 12,239,172 B2
(45) Date of Patent: Mar. 4, 2025

(54) CLOTHING

(71) Applicant: FAST RETAILING CO., LTD., Yamaguchi (JP)

(72) Inventor: Masahiko Furuta, Yamaguchi (JP)

(73) Assignee: FAST RETAILING CO., LTD., Yamaguchi (JP)

( * ) Notice: Subject to any disclaimer, the term of this patent is extended or adjusted under 35 U.S.C. 154(b) by 75 days.

(21) Appl. No.: 18/269,035

(22) PCT Filed: Sep. 22, 2021

(86) PCT No.: PCT/JP2021/034912
§ 371 (c)(1),
(2) Date: Jun. 22, 2023

(87) PCT Pub. No.: WO2022/137682
PCT Pub. Date: Jun. 30, 2022

(65) Prior Publication Data

US 2024/0041140 A1 Feb. 8, 2024

(30) Foreign Application Priority Data

Dec. 23, 2020 (JP) ..... 2020-214028

(51) Int. Cl.
*A41D 13/00* (2006.01)
*A41D 3/02* (2006.01)
(Continued)

(52) U.S. Cl.
CPC ..... *A41D 13/0051* (2013.01); *A41D 3/02* (2013.01); *A41D 31/12* (2019.02); *A41D 2200/20* (2013.01)

(58) Field of Classification Search
CPC ..... A41D 13/0051; A41D 3/02; A41D 3/00; A41D 13/00; A41D 13/002; A41D 31/02; A41D 31/06
See application file for complete search history.

(56) References Cited

U.S. PATENT DOCUMENTS 1,345,046 A * 6/1920 Wedlock ..... A41D 31/06 112/421
1,924,935 A * 8/1933 Klein ..... A41D 31/02 112/420
(Continued)

FOREIGN PATENT DOCUMENTS

JP 2013044075 4/2013
JP 5879139 8/2013
(Continued)

OTHER PUBLICATIONS

International Search Report issued on Oct. 8, 2021 in corresponding Application No. PCT/JP2021/034912, 10 pages.
(Continued)

*Primary Examiner* — Khaled Annis
(74) *Attorney, Agent, or Firm* — Andrew M. Calderon; Calderon Safran & Wright P.C.

(57) ABSTRACT

In a clothing, inside which a plurality of packs are disposed, the plurality of packs are disposed on the same surface and disposed to partially overlap each other. The plurality of packs include a first pack and a second pack disposed immediately above the first pack, and an upper joining line defining an upper side of the first pack on the same surface is above a lower end of the second pack.

7 Claims, 8 Drawing Sheets

(51) Int. Cl.
*A41D 13/005* (2006.01)
*A41D 31/12* (2019.01)

(56) References Cited

U.S. PATENT DOCUMENTS 2,651,041 A * 9/1953 Sunderland ..... A41D 3/02 2/97
4,048,675 A * 9/1977 Griffin ..... A41D 3/00 2/93
4,320,538 A * 3/1982 Saft ..... A41D 3/00 2/93
4,354,281 A * 10/1982 Satoh ..... A47G 9/086 5/413 R
4,547,906 A * 10/1985 Nishida ..... A41D 13/002 5/413 R
4,665,849 A * 5/1987 Kelly ..... D05B 23/00 112/155
5,437,239 A * 8/1995 Blake ..... B32B 5/06 112/470.31
5,713,079 A * 2/1998 Simon ..... A41D 3/00 2/243.1
5,799,600 A * 9/1998 Reuben ..... A47G 9/0207 112/475.08
7,094,714 B2 * 8/2006 Lap ..... A41D 31/065 5/413 R
2003/0182708 A1 * 10/2003 Gathings, Jr. ..... A41D 3/02 2/97
2006/0195964 A1 * 9/2006 Bury ..... A41D 31/065 2/108
2007/0245448 A1 * 10/2007 Bury ..... A41D 3/00 2/108
2009/0255031 A1 * 10/2009 McIntosh ..... A41D 13/0005 2/87
2013/0205481 A1 * 8/2013 Underwood ..... A41D 1/06 2/455
2014/0250575 A1 * 9/2014 Man ..... B32B 5/26 112/117
2015/0201683 A1 * 7/2015 Maud ..... A41D 13/002 428/72
2017/0238623 A1 * 8/2017 Wallace ..... A41D 3/00
2017/0303607 A1 * 10/2017 Iser ..... A41D 27/20
2018/0042319 A1 * 2/2018 Fowler ..... A41D 3/00
2018/0116317 A1 * 5/2018 Inoue ..... A41D 31/02
2019/0150541 A1 * 5/2019 Man ..... A41D 31/06
2021/0156057 A1 * 5/2021 Ogata ..... D04B 1/16
2022/0378130 A1 * 12/2022 Brandt ..... D04H 1/498
2024/0041140 A1 * 2/2024 Furuta ..... A41D 3/02

FOREIGN PATENT DOCUMENTS

JP 2014139352 7/2014
JP 2015134976 7/2015
JP 2016509138 3/2016
JP 2019069035 5/2019
JP 2024089060 A * 7/2024
WO 2016121492 4/2016

OTHER PUBLICATIONS

Japanese Office Action issued Oct. 13, 2021 in corresponding Application No. JP2020214028, 8 pages.

* cited by examiner

CLOTHING

TECHNICAL FIELD

The present invention relates to clothing.

BACKGROUND ART

As clothing for cold weather, for example, there is a down jacket in which a filling material such as down is disposed between a top fabric and a backing fabric. This type of fabric has excellent heat retention because the filling material is enclosed in a bag-like pack formed by sewing the top fabric and the backing fabric together. However, at the joint parts where the top fabric and the backing fabric are sewn together, the filling material may not be disposed or the fabric may be crushed, resulting in a decrease in the thickness of the fabric and poor heat retention.

Proposals have been made to deal with the decrease in heat retention at such joint parts (for example, refer to JP5879139B and WO2016/121492A). JP5879139B1 discloses cold weather clothing in which a top fabric, a middle fabric, and a backing fabric are laminated and a heat insulating material is inserted between each fabric, in which a seam for sewing the top fabric and the middle fabric and a seam for sewing the middle fabric and the backing fabric are provided at various positions not facing each other. WO2016/121492A discloses a heat insulating article having a filling material between a first sheet and a second sheet, in which a plurality of joined areas of the first sheet and the second sheet are separated from each other and scattered.

SUMMARY

Technical Problem

According to the techniques described in JP5879139B and WO2016/121492A, although the decrease in heat retention in the cold weather clothing or heat insulating article itself can be alleviated, the heat retention at the joint parts (seams) between the fabrics is still inferior to heat retention at parts other than the joint parts.

The present invention has been made in view of the circumstances described above, and an object thereof is to provide clothing with improved heat retention at joint parts between fabrics.

DESCRIPTION OF EMBODIMENTS

Hereinafter, clothing according to embodiments of the present invention will be described with reference to the drawings. The configuration described below is an example as an embodiment of the present invention, and the present invention is not limited to this, and modifications can be made within the scope of the present invention.

Figure 1:
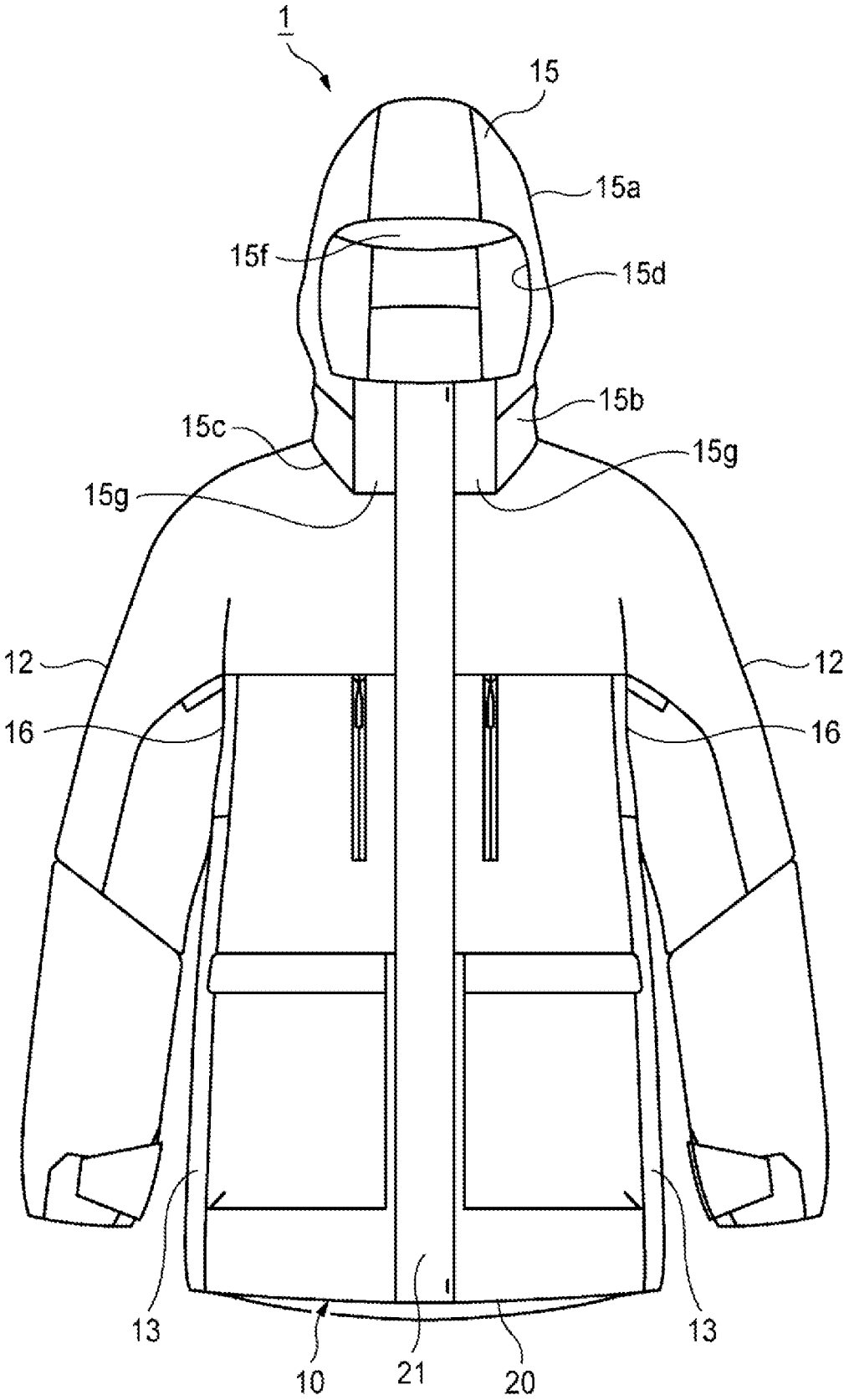
FIG. 1 is a front view of clothing.
Figure 2:
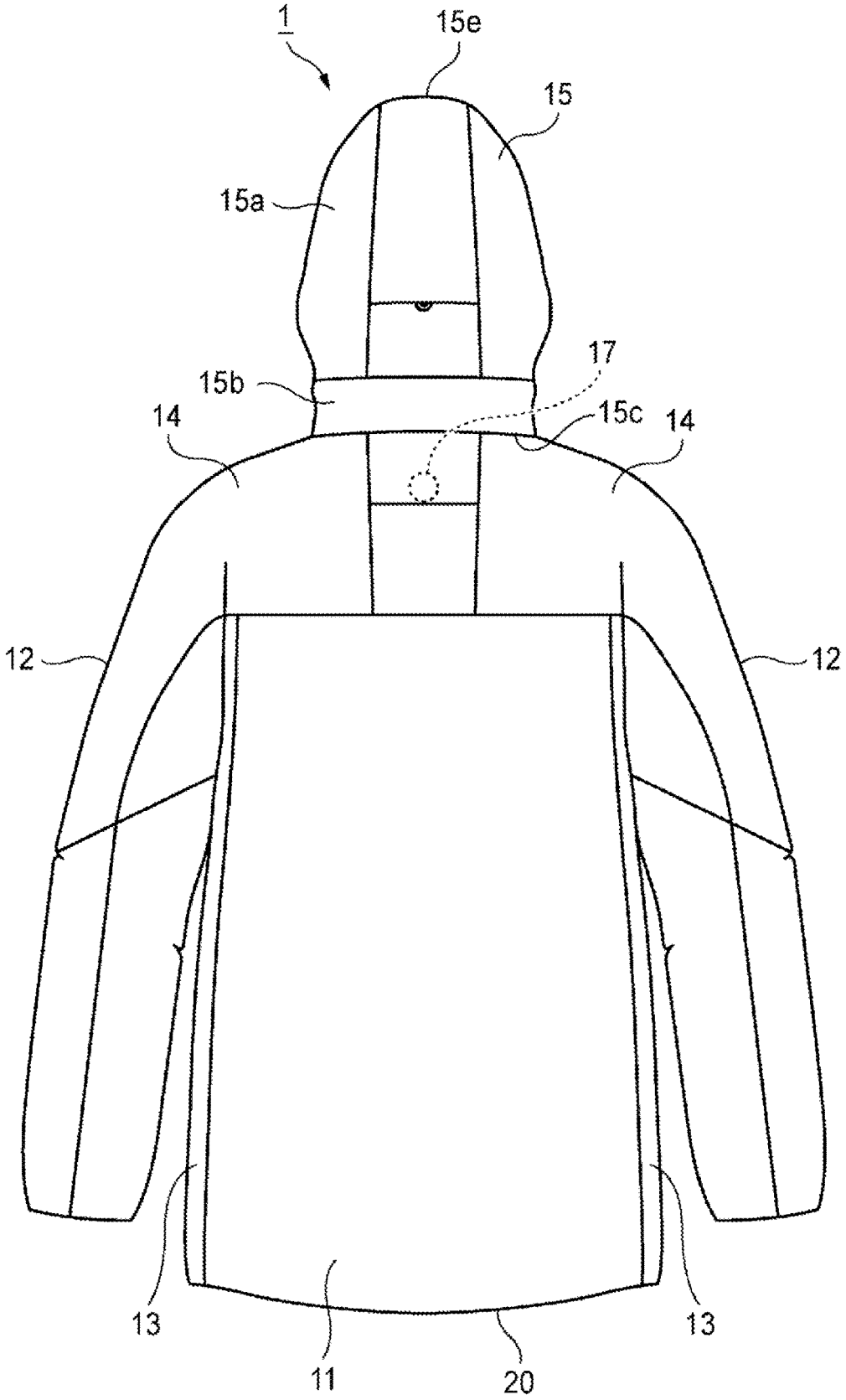
FIG. 2 is a rear view of clothing.

FIG. 1 is a front view of a clothing 1 of the present embodiment, and FIG. 2 is a rear view of the clothing 1. The clothing 1 of the present embodiment is, for example, a jacket, a parka, or a coat.

The clothing 1 includes a front body part 10, a back body part 11, sleeve portions 12, side portions 13, shoulder portions 14, and a hood 15.

Each of the front body part 10, the back body part 11, the sleeve portions 12, the side portions 13, the shoulder portions 14, and the hood 15 has a cold protection area in which a cold protection material is enclosed.

Figure 3:
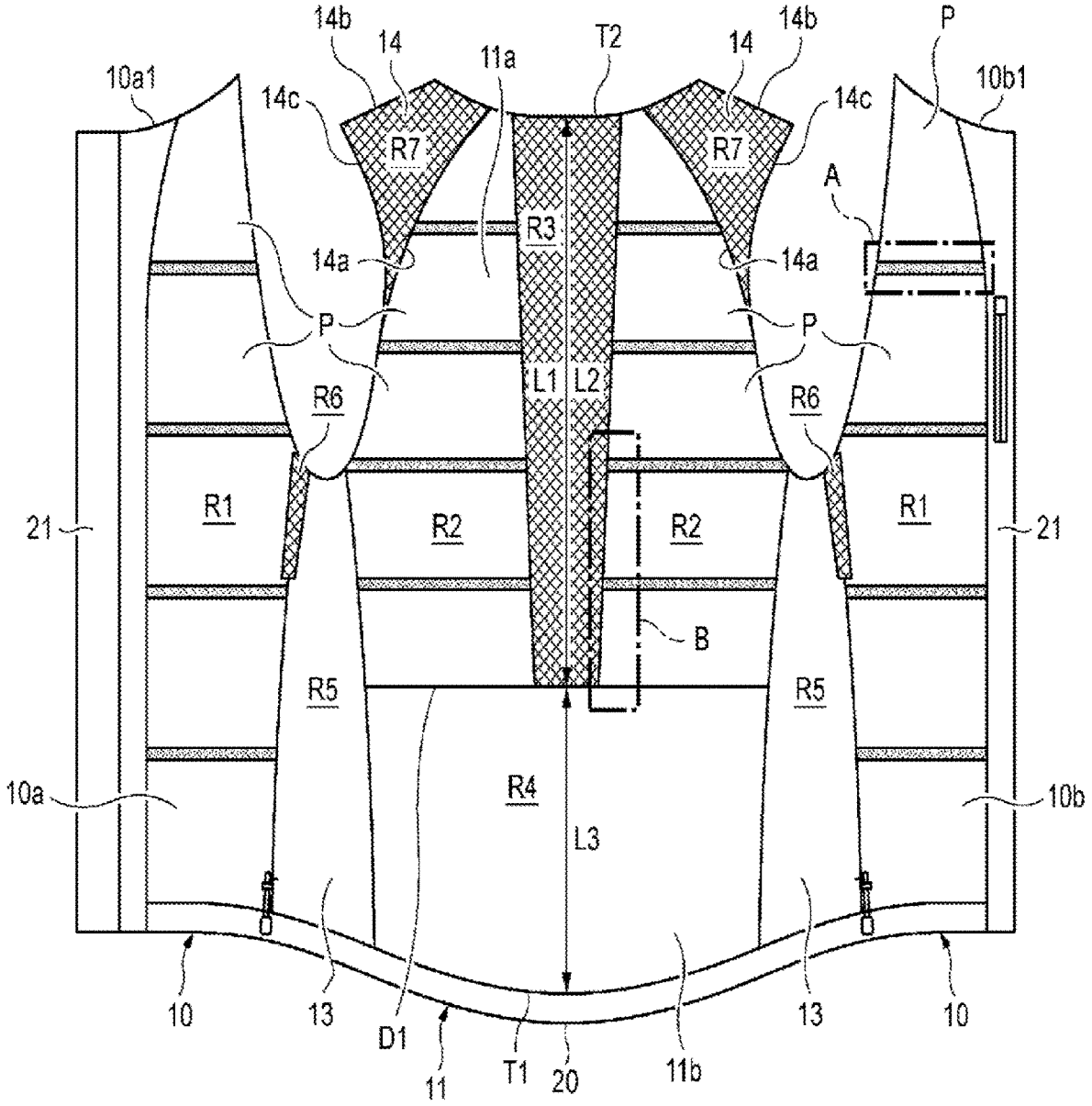
FIG. 3 is an explanatory view showing clothing unfolded.

FIG. 3 is an unfolded view of the clothing 1 in an open state viewed from the inside, and schematically shows cold protection areas and mesh areas provided in each of the front body part 10, the back body part 11, the side portions 13, and the shoulder portions 14. In the cold protection area of each part, cold protection material, either down or cotton material, is enclosed as a filling material. A mesh material such as double raschel is provided inside the clothing 1 in the mesh area. The inside of the clothing 1 is a part facing a wearer when the clothing 1 is worn.

The down, which will be described later in detail, is enclosed by, for example, providing a gap between an outer fabric and an inner fabric of the clothing 1, filling the gap with down, and closing the gap by sewing or the like. In other words, the down is disposed in a predetermined area as a pack disposed as a filling material in a space formed between the outer fabric and the inner fabric and partitioned by joining the outer fabric and the inner fabric. The cotton material is formed in a sheet shape, for example, and is enclosed by being sandwiched between the inner fabric and the outer fabric of the clothing 1 and sewn together. In the present disclosure, "up", "down", "up and down", and "left and right" are directions based on the clothing 1 shown in FIGS. 1 to 3.

Here, down is a material containing at least one of down and feathers. The cotton material is a material containing cotton, or a material containing chemical fibers substantially the same as cotton, such as rayon fiber, polyester fiber, polyolefin fiber, acrylic fiber, and acrylate fiber. Down is lighter and has better heat retention than cotton, and the cotton material is stronger and more resistant to water than down. Furthermore, as the cotton material, moisture-absorbing heat-generating functional cotton may be used.

As shown in FIG. 3, the front body part 10 has a down area R1 in which down is enclosed. The down area R1 is provided on each of a right front body part 10*a* and a left front body part 10*b*. The down area R1 is a substantially rectangular area elongated in the up-down direction in the right front body part 10*a* and the left front body part 10*b*.

The down area R1 is provided over substantially the entirety of the front body part 10, including the upper portion and the lower portion excluding a hem portion 20 and a front placket portion 21, for example. The front placket portion 21 is a part with buttons and fasteners for fixing the right front body part 10*a* and the left front body part 10*b* together, and is a part elongated in the up-down direction and provided at the end portion on the center side of the right front body part 10*a* and the left front body part 10*b*. The down area R1 is provided to cover the chest, abdomen, and lower abdomen of the wearer of the clothing 1.

The back body part 11 has, for example, an upper portion 11*a* covering the back of the wearer of the clothing 1 and a lower portion 11*b* covering the buttocks of the wearer. At the back body part 11, down areas R2 which are disposed on the left and right sides and enclose a down material are provided at the upper portion 11*a* thereof, and a mesh area R3 which is disposed linearly in the up-down direction and has a mesh material therein is provided between the left and right down areas R2 (center). Further, the back body part 11 has a cotton area R4 in which a cotton material is enclosed in the lower portion 11*b* thereof.

The down area R2 is disposed in substantially rectangular areas on the left and right sides of the upper portion 11*a* of the back body part 11, and the mesh area R3 is disposed in a substantially rectangular area elongated in the up-down direction along the spine of the wearer at the center of the upper portion 11*a* of the back body part 11. The mesh area R3 has a shape of which the width slightly narrows from the upper portion to the lower portion. The cotton area R4 is disposed in a substantially rectangular area of the lower portion 11*b* of the back body part 11.

The mesh area R3 is provided in the area from a boundary line D1 to an upper end T2 between the left and right down areas R2 in the upper portion 11*a* of the back body part 11. The boundary line D1 is formed in a straight line extending in the left-right direction between the down area R2 and the mesh area R3 (upper portion 11*a*) and the cotton area R4 (lower portion 11*b*).

The cotton area R4 is provided in an area from a lower end T1 of the lower portion 11*b* of the back body part 11 excluding the hem portion 20 to the boundary line D1.

The boundary line D1 is provided at a position apart from the lower end T1 toward the upper end T2 by 10% or more and 60% or less, preferably 15% or more and 40% or less of the total length L1 of the back body part 11 in the up-down direction. The total length L2 in the up-down direction of the mesh area R3 and the down area R2 (upper portion 11*a*) is set to, for example, 35 cm or more and 70 cm or less, preferably 45 cm or more and 60 cm or less. Further, the total length L3 in the up-down direction of the cotton area R4 (lower portion 11*b*) is set to, for example, 10 cm or more and 40 cm or less, preferably 15 cm or more and 35 cm or less.

Further, the total length ratio (L2:L3) between the upper portion 11*a* and the lower portion 11*b* of the back body part 11 is set within a range of 6 to 0.8:1, for example.

The sleeve portion 12 shown in FIGS. 1 and 2 has a down area (not shown) in which a down material is enclosed in the entirety thereof. In addition, the "entire sleeve portion 12" referred to here may be substantially the entire sleeve portion 12, and means, for example, 90% or more of the surface area of the sleeve portion 12. The down areas of the sleeve portion 12 have the same configuration as the down areas R1 and R2, which will be described later.

The side portions 13 shown in FIG. 3 are positioned below the sleeve portions 12 between the front body part 10 and the back body part 11 in the left-right direction. The side portion 13 has a cotton area R5 in which a cotton material is enclosed in the entirety thereof.

In addition, the "entire side portion 13" referred to here may be substantially the entire side portion 13, and means, for example, 90% or more of the surface area of the side portion 13. For example, the hem portion 20 of the side portion 13 may not be provided with the cotton area R5. The cotton area R5 is disposed in a substantially rectangular area elongated in the up-down direction and surrounded by the front body part 10, the back body part 11, and the sleeve portion 12.

Between the side portion 13 and the right front body part 10*a*, and between the side portion 13 and the left front body part 10*b*, mesh areas R6 provided with a mesh material are disposed respectively. The mesh area R6 extends from between the side portion 13 and the right front body part 10*a* and between the side portion 13 and the left front body part 10*b*, to each position (the position of the lower side part of the wearer) across the sleeve portions 12 on the left and right sides.

The shoulder portion 14 is formed in a strip shape from the sleeve portion 12 toward the collar on the back side of the wearer. The shoulder portion 14 has an outer edge composed of, for example, a side end edge 14*a* on the back body part 11 side, an upper end edge 14*b* on the hood 15 side, and a lower end edge 14*c* on the sleeve portion 12 side.

The side end edge 14*a* of the shoulder portion 14 connects the base end edge of the sleeve portion 12 and a lower end edge 15*c* of a collar portion 15*b* which is further on the center side of the clothing 1, and extends diagonally to gradually rise from the base end edge of the sleeve portion 12 toward the lower end edge 15*c* of the collar portion 15*b*. As shown in FIG. 3, the shoulder portion 14 has a mesh area R7 provided with a mesh material over the entirety thereof.

As shown in FIGS. 1 and 2, the hood 15 has a main body portion 15*a* and the collar portion 15*b*. The main body portion 15*a* is a part including at least a top portion 15*e*, and is formed in a dome shape to cover the head of the wearer. For example, a substantially rectangular opening portion 15*d* for exposing at least the eyes and nose of the face of the wearer is provided on the front side of the main body portion 15*a*. A flange portion 15*f* is provided along the upper end of the opening portion 15*d*.

The collar portion 15*b* is a part surrounded by the front body part 10, the back body part 11, the shoulder portions 14, and the main body portion 15*a*, and is formed in a strip shape to cover the neck of the wearer. The main body portion 15*a* has a cotton area in which a cotton material is enclosed. The collar portion 15*b* has a down area in which a down material is enclosed.

In addition, for example, the flange portion 15*f* and a front portion 15*g* of the hood 15 may not be provided with a cold protection area. The hood 15 may be detachable from the main body of the clothing 1 or may be permanently fixed to the main body of the clothing 1. The hood 15 is not limited to the shape described above as long as the hood 15 covers the head of the wearer.

<Down Areas R1 and R2>

As shown in FIG. 3, in the down areas R1 and R2 of the clothing 1, a plurality of packs P are disposed inside. The pack P is a bag-like fabric in which down is enclosed as a filling material. The plurality of packs P are disposed on the same surface and are disposed to partially overlap each other. Down areas similar to the down areas R1 and R2 are also formed in the sleeve portion 12 of the clothing 1.

Figure 4:
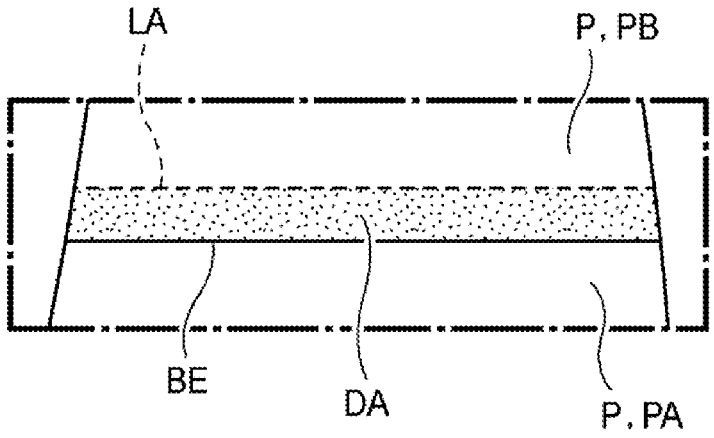
FIG. 4 is an enlarged view of a part A in FIG. 3.

FIG. 4 is an enlarged view of a part A in FIG. 3. In FIG. 4, an upper joining line LA that defines the upper side of a lower pack P (hereinafter also referred to as a first pack PA) is covered with an upper pack P (hereinafter also referred to as a second pack PB), and an area between the upper joining line LA and a lower end BE of the second pack PB is an overlapping part of the plurality of packs P. In this overlapping part, dead air DA (immovable air) is formed between the plurality of packs P, and thus the heat retention effect at the upper joining line LA is improved. As shown in FIG. 3, in the down areas R1 and R2, a plurality of packs P are disposed to partially overlap each other as described above in the up-down direction.

Figure 5:
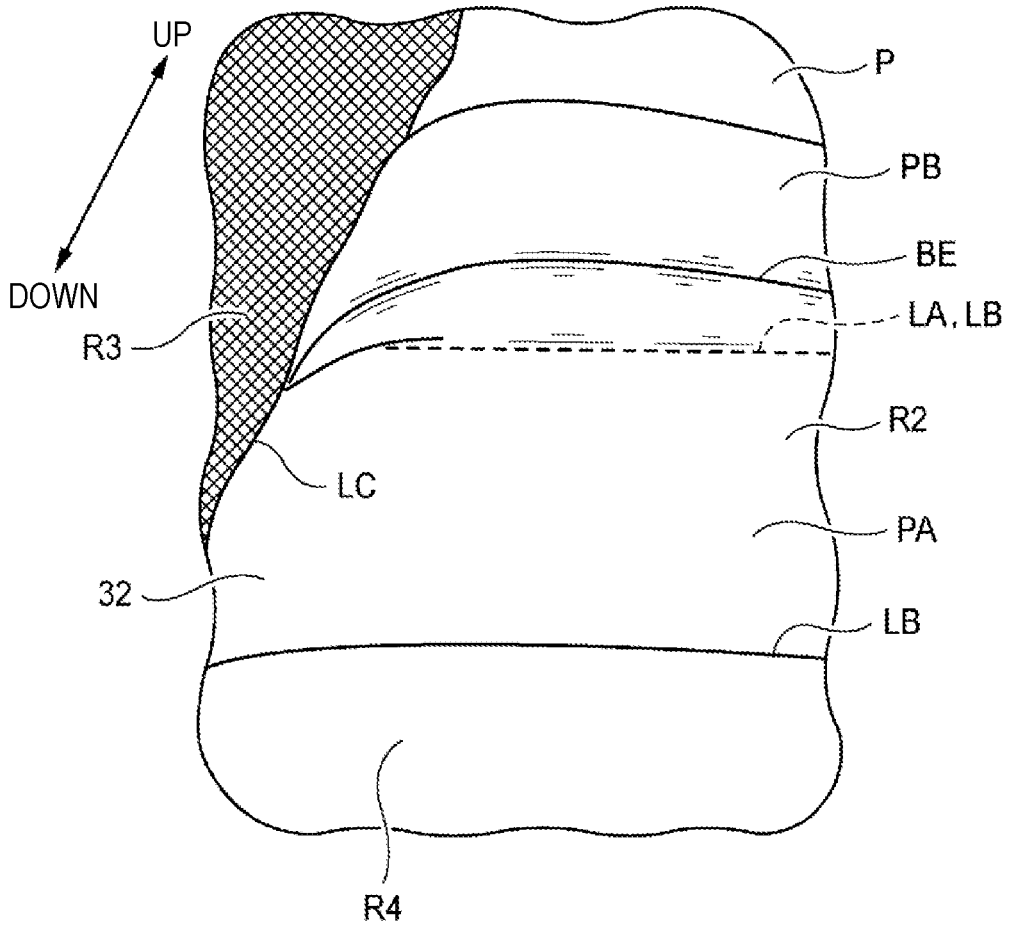
FIG. 5 is an enlarged perspective view of a part B in FIG. 3.
Figure 6:
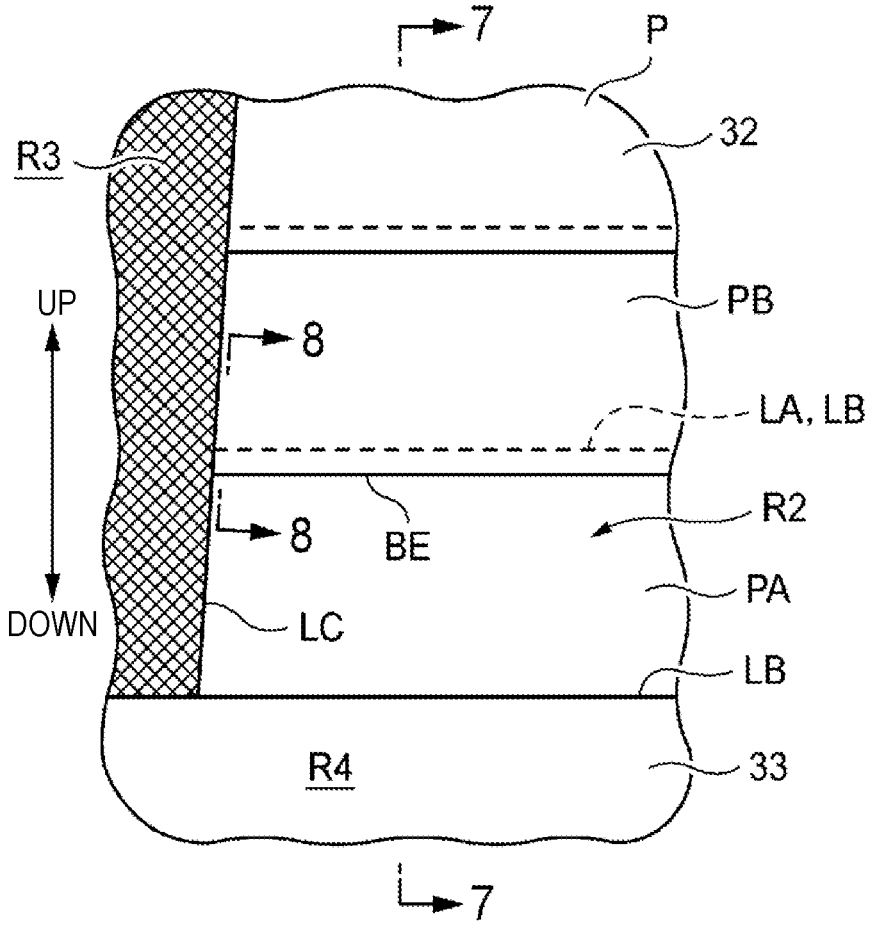
FIG. 6 is an explanatory view of the part B in FIG. 3.
Figure 7:
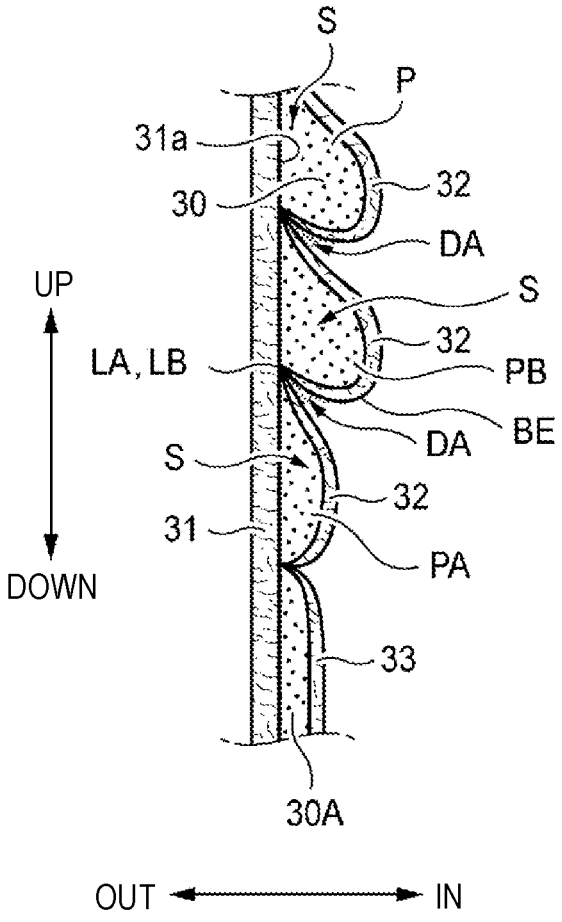
FIG. 7 is a cross-sectional view taken along line 7-7 in FIG. 6.
Figure 8:
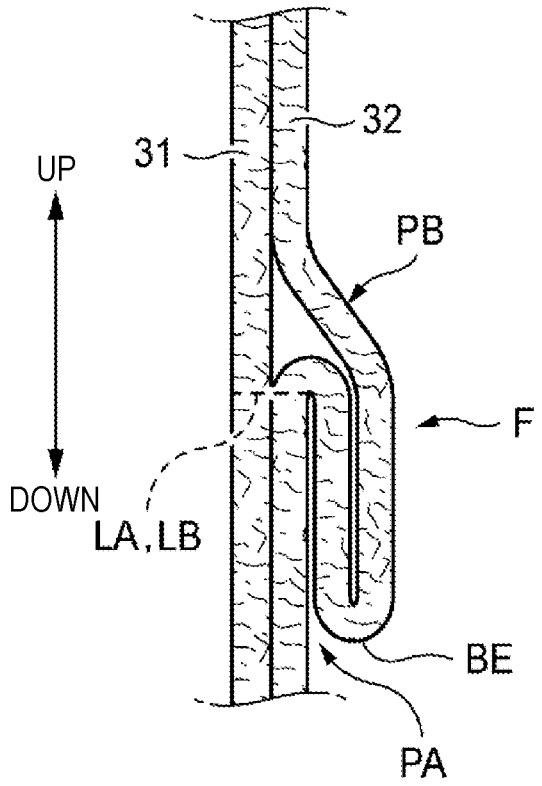
FIG. 8 is a cross-sectional view taken along line 8-8 in FIG. 6.

The overlapping parts of the plurality of packs P will be described in detail with reference to FIGS. 5 to 8. As an example, the overlapping part between the first pack PA and the second pack PB will be described below, but the same also applies to the other packs P. FIG. 5 is an enlarged perspective view of a part B in FIG. 3, and shows a state where the overlapping part between the first pack PA and the second pack PB is viewed from below. FIG. 6 is an explanatory view of the part B in FIG. 3, and FIGS. 7 and 8 are cross-sectional views taken along lines 7-7 and 8-8 of FIG. 6, respectively. As shown in FIGS. 5 and 6, the down area R2 adjacent to the upper side of the cotton area R4 includes the first pack PA and the second pack PB disposed immediately above the first pack PA. In the cotton area R4, as shown in FIG. 7, batting made of, for example, a sheet-like cotton material is disposed between the inner fabric 33 and the outer fabric 31.

The first pack PA and the second pack PB each have the outer fabric 31, the inner fabric 32, and down as the filling material 30, as shown in FIG. 7. The space S is formed between the outer fabric 31 and the inner fabric 32, and the filling material 30 is disposed in this space S. The space S is a space partitioned by joining lines (upper joining line LA, lower joining line LB) between the outer fabric 31 and the inner fabric 32. A joining line means a substantially linear joint part formed by sewing, thermocompression bonding, adhesion, or the like, and includes not only continuous joint parts but also discontinuous joint parts extending in one direction. The upper joining line LA defines the upper side of the first pack PA on the same surface 31*a*, and the lower joining line LB defines the lower side of the second pack PB on the same surface 31*a*. The outer fabric 31 and the inner fabrics 32 and 33 may be immediately joined, or may be joined with the filling material 30 or other members interposed therebetween.

Various fabrics can be used for the outer fabric 31 and the inner fabrics 32 and 33, and as an example, a high-density nylon material can be used. By using a material such as a high-density nylon material with tight stitches as the outer fabric 31 and the inner fabrics 32 and 33, a cloth bag for enclosing the filling material 30, such as a so-called down pack, becomes unnecessary, and weight reduction can be achieved. The outer fabric 31 and the inner fabrics 32 and 33 may be made of different materials or the same material. A series of fabrics can be used for the outer fabric 31 for the down area R2 and the cotton area R4. A series of fabrics can be used for the inner fabrics 32 and 33.

The first pack PA and the second pack PB have a substantially rectangular shape when viewed from the front, and in each space S of the first pack PA and the second pack PB, an upper side and a lower side are defined by the upper joining line LA and the lower joining line LB between the outer fabric 31 and the inner fabric 32. In the present embodiment, the upper joining line LA of the first pack PA is shared with the lower joining line LB of the second pack PB. That is, one joining line defines the boundary between the first pack PA and the second pack PB. In addition, in each space S of the first pack PA and the second pack PB, one side is defined by a side joining line LC (refer to FIGS. 5 and 6) forming a boundary with the mesh area R3, and the other side is defined by a side joining line forming a boundary with the cotton area R5. The cotton area R5 is configured similarly to the cotton area R4.

As shown in FIG. 6, the upper joining line LA that defines the upper side of the first pack PA on the same surface 31*a* is above the lower end BE of the second pack PB. In addition, the lower joining line LB that defines the lower side of the second pack PB on the same surface 31*a* is above the lower end BE of the second pack PB. In FIG. 5, a part of the lower end BE of the second pack PB (the swollen part of the second pack PB) appears to be positioned above the upper joining line LA of the first pack PA (the lower joining line LB of the second pack PB), but this is because the swollen part of the second pack PB is viewed from below.

As shown in FIG. 7, the filling material 30 is enclosed in each of the first pack PA and the second pack PB, and the inner fabric 32 of the second pack PB is swollen downward inside. The swollen lower end BE of the second pack PB is separated from the inner fabric 32 of the first pack PA. A gap is provided between the part from the lower end BE to the lower joining line LB on the inner fabric 32 of the second pack PB and the part covered with the second pack PB (overlapping the second pack PB) when viewed inward and outward on the inner fabric 32 of the first pack PA. In other words, when viewed inward and outward from the same surface 31*a* of the outer fabric 31, the bottom of the inner fabric 32 of the second pack PB (a part including the lower end BE) and the top of the inner fabric 32 of the first pack PA (a part including the part immediately below the upper joining line LA) face each other with a gap interposed therebetween. In this gap, the dead air DA is formed, the warmed air stays without moving, and thus the heat retention is improved.

In this manner, the upper joining line LA of the first pack PA (the joint part between the inner fabric 32 and the outer fabric 31) is covered with the second pack PB, the dead air DA is formed between the first pack PA and the second pack PB, and thus the heat retention at the joint part can be improved.

As shown in FIG. 8, the second pack PB is joined to the inner fabric 32 of the first pack PA in a state where the inner fabric 32 is folded below the side joining line LC that defines the side of the same surface 31*a* (a state where a folded portion F is provided). Since the inner fabric 32 is folded back below the side of the second pack PB and joined to the inner fabric 32 of the first pack PA, the overlapping state between the first pack PA and the second pack PB is maintained, and the dead air DA can be reliably formed.

At the folded portion F of the second pack PB, the inner fabric 32 is joined to the outer fabric 31 in a state of being bent at the position of the upper joining line LA of the first pack PA and the position of the lower end BE of the second pack PB, that is, in a state of being folded in a Z shape. In each of the down areas R1 and R2, a series of fabrics are used as the inner fabrics 32 of the plurality of packs P, and in a state where these fabrics are folded in a Z shape at the lower end of each pack P, by sewing these fabrics to the outer fabric 31, the clothing 1 with improved heat retention can be realized by a simple method.

(Mesh Areas R3, R7, R6)

Figure 9:
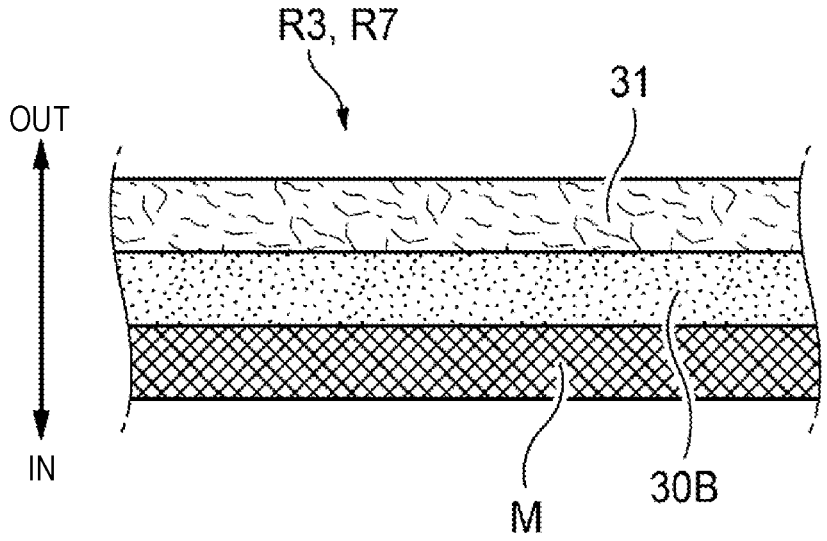
FIG. 9 is a cross-sectional view of a mesh area.

FIG. 9 is a cross-sectional view in the thickness direction of the mesh areas R3 and R7. The mesh areas R3 and R7 have a three-layer structure in which a mesh fabric M, batting 30B, and the outer fabric 31 are laminated in the order from the inside (inner side) facing the wearer. The mesh fabric M is made of a mesh material such as double raschel. The batting 30B is made of a sheet-shaped cotton material, for example. The batting 30B may be made of the same material as or different from the batting 30A of the cotton areas R4 and R5. The outer fabric 31 is made of, for example, a high-density nylon material.

In the mesh areas R3 and R7, the mesh fabric M is in contact with the wearer to improve air permeability, and the batting 30B and the outer fabric 31 can maintain heat retention.

The mesh area R3 is disposed linearly along the spine of the wearer at the back part of the back body part 11 covering the back and waist of the wearer, and the mesh area R7 is disposed in the shoulder portion 14. By disposing the mesh areas R3 and R7 at the part where perspiration is likely to occur and the part where the body temperature tends to rise in this manner, efficient circulation of the air trapped inside can be promoted.

In addition, by using a cotton material having a moisture absorption and heat generation function as the batting 30B, the batting 30B absorbs moisture trapped inside the clothing 1 and generates heat. That is, by making the mesh areas R3 and R7 into a three-layer structure of the mesh fabric M, the batting 30B having a moisture absorption and heat generation function, and the outer fabric 31, the moisture inside the clothing 1 is actively removed, the comfort of the wearer is maintained, and the warmth can be improved.

The mesh area R6 has a two-layer structure in which the batting 30B is excluded from the structure shown in FIG. 9. The outer fabric 31 of the mesh area R6 includes ventilation holes provided at each position from between the side portion 13 and the right front body part 10*a* and between the side portion 13 and the left front body part 10*b* to the right and left sleeve portions 12, and an opening/closing portion 16 (refer to FIG. 1) that covers the ventilation hole. The ventilation hole can be opened and closed by the opening/closing portion 16 such as a slide fastener. When the opening/closing portion 16 is opened, the mesh fabric M of the mesh area R6 is exposed to the outside, and the inside and the outside of the clothing 1 communicate with each other through the mesh fabric M. On the other hand, when the opening/closing portion 16 is closed, the ventilation hole is closed and the air inside the clothing 1 is retained. Therefore, the wearer can obtain desired air permeability and/or heat retention by opening and closing the opening/closing portion 16. In the mesh area R6, two layers of the mesh fabric M are used, and accordingly, air permeability can be maintained and the durability in the state where the opening/closing portion 16 is opened can be improved.

(Air Hole 17)

Figure 10A:
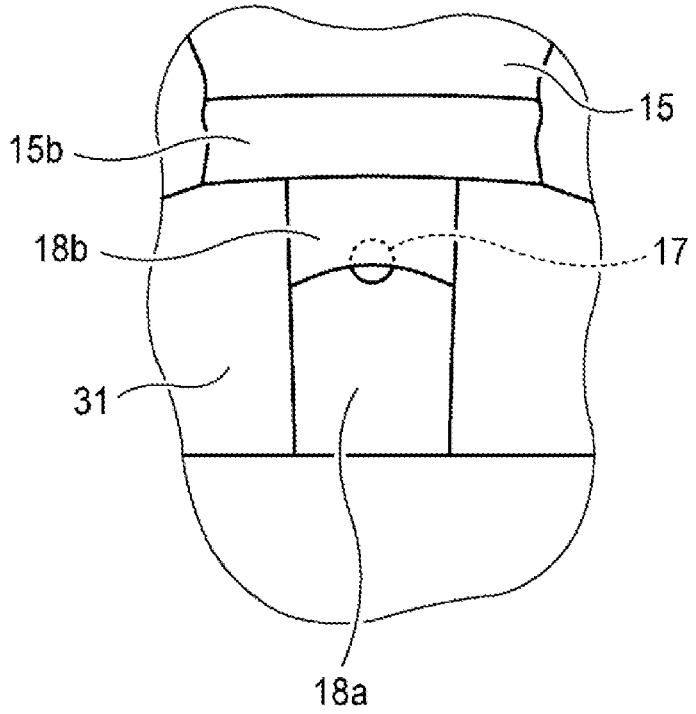
FIG. 10A is an explanatory view of an air hole.
Figure 10B:
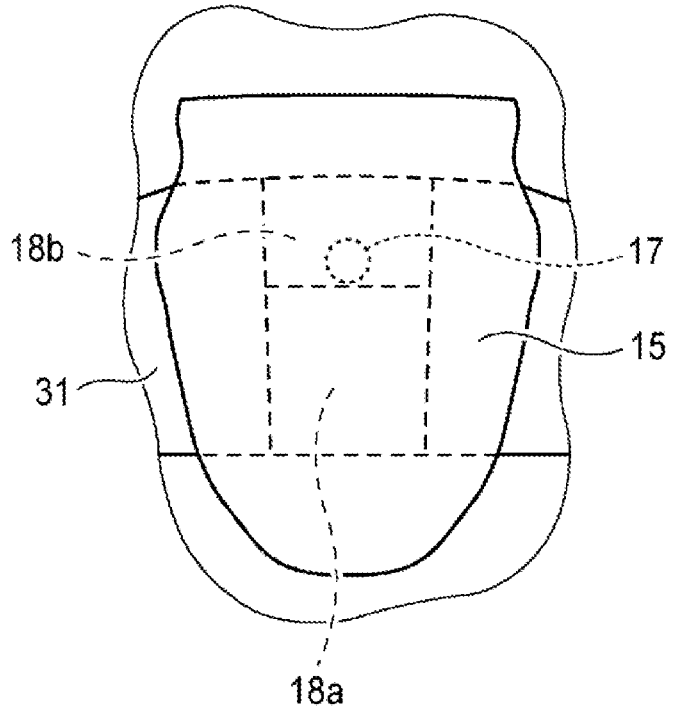
FIG. 10B is an explanatory view of an air hole.

FIGS. 10A and 10B are explanatory views of the air hole 17, and are views of the periphery of a part 18*a* corresponding to the back of the neck of the wearer when viewed from the back side. FIG. 10A shows a state where the wearer is wearing the hood 15, and FIG. 10B shows a state where the wearer does not wear the hood 15. Furthermore, in FIG. 10B, the opening portion 15*d* and the flange portion 15*f* of the hood 15 are omitted. The outer fabric 31 of the back body part 11 has an air hole 17 at the part 18*a* corresponding to the back of the neck of the wearer. The outer fabric 31 has a cover 18*b* capable of opening and closing the air hole 17. Air passing through the mesh area R3 linearly provided to cover the back and waist of the wearer is released to the outside of the clothing 1 through the air hole 17. By releasing the air trapped inside through the air hole 17 to the outside, the circulation of the air can be further promoted.

The air hole 17 is provided at a position covered with the hood 15. With this configuration, the cover 18*b* opens the air hole 17 as shown in FIG. 10A when the wearer wears the hood 15, and closes the air hole 17 as shown in FIG. 10B when the wearer does not wear the hood 15.

The clothing 1 has a plurality of packs P disposed in an overlapping manner on the same surface 31*a* in the down areas R1 and R2, the dead air DA is formed, and accordingly, heat retention capacity (warmth) is extremely high. When the clothing 1 is worn in a low temperature environment such as −15° C. to −20° C., when the wearer wears the hood 15, the warmth increases by covering the head, but it can be warm enough to make the wearer sweat. Therefore, when the wearer wears the hood 15, the cover 18*b* is opened. Since the inside and outside of the clothing 1 communicate with each other through the open air hole 17, air containing moisture near the back part of the wearer is released to the outside through the mesh area R3 and the air hole 17. With this configuration, it is possible to improve the warmth when the wearer wears the hood 15 and to improve comfort by removing the moisture inside the clothing 1.

By using a cotton material having a moisture absorption and heat generation function as the batting 30B of the mesh area R3, the moisture trapped inside the mesh area R3 can be actively absorbed, the internal air can be released to the outside through the air hole 17, and the circulation of the air can be promoted.

On the other hand, when the wearer does not wear the hood, the air hole 17 is closed by the cover 18*b* and the hood 15. Accordingly, the inside and the outside of the clothing 1 do not communicate with each other through the air hole 17, and heat retention on the inside of the clothing 1 is maintained.

According to the present embodiment, in the down areas R1 and R2 (including the down areas in the sleeve portions 12, the same applies hereinafter) provided in the entire front body part 10 and on the left and right sides of the upper portion 11*a* of the back body part 11, the plurality of packs P are disposed on the same surface 31*a* and are disposed to partially overlap each other. As a result, the dead air DA is formed between the plurality of packs P (the first pack PA and the second pack PB) that overlap each other, and thus the heat retention (heat retention effect) at the overlapping parts of the packs P is improved. That is, it is possible to improve the heat retention at the joint parts, which are the edges of the pack P formed by joining the fabrics together.

In the down areas R1 and R2, the upper joining line LA that defines the upper side of the first pack PA on the same surface 31*a* is above the lower end BE of the second pack PB. As a result, the dead air DA is formed between the lower end BE of the second pack PB and the upper joining line LA of the first pack PA. Therefore, the low-bulk part (cold spot) on the upper side of the first pack PA can be covered with the dead air DA and the second pack PB to improve the heat retention effect.

In the down areas R1 and R2, the lower joining line LB that defines the lower side of the second pack PB on the same surface 31*a* is above the lower end BE of the second pack PB. As a result, the dead air is formed between the lower end BE of the second pack PB and the upper joining line LA of the first pack PA. Therefore, the low-bulk part on the lower side of the second pack PB can be covered with the dead air DA and the second pack PB to improve the heat retention effect.

In the down areas R1 and R2, the inner fabric 32 is joined to the inner fabric of the first pack PA in a state of being folded below the side joining line LC that defines the side of the second pack P. That is, the inner fabric 32 is folded back below the side of the second pack PB and joined to the inner fabric 32 of the first pack PA. As a result, the dead air DA can be reliably formed by maintaining the overlapping state between the first pack PA and the second pack PB.

In the down areas R1 and R2, the inner fabric 32 of the first pack PA and the inner fabric 32 of the second pack PB are a series of fabrics. As a result, the clothing 1 with improved heat retention can be realized by a simple method, for example, by folding a sheet of the inner fabric 32 into a Z shape and sewing the inner fabric 32 to the outer fabric 31.

By disposing the mesh areas R3, R6, and R7, air permeability can be improved. The mesh areas R3, R6, and R7 are disposed in positions close to the down areas R1 and R2 where the dead air DA is formed by disposing the plurality of packs P in an overlapping manner, and accordingly, air permeability at the parts where the body temperature tends to rise can be improved. As a result, it is possible to realize winter clothing with improved heat retention and air permeability.

The mesh areas R3 and R7 have a structure in which the mesh fabric M, the batting 30B, and the outer fabric 31 are laminated in order from the inner side. Accordingly, the mesh fabric M is in contact with the wearer to improve air permeability, and the batting 30B and the outer fabric 31 can maintain heat retention.

The mesh areas R3 and R7 are disposed on at least one of the back part of the back body part 11 covering the back and waist of the wearer, and the shoulder portions 14. In this manner, by disposing the mesh areas at the part where perspiration is likely to occur and the part where the body temperature tends to rise in this manner, the air trapped inside can be efficiently released to the outside, and the circulation of the air can be promoted.

Since the dead air DA is formed in the down areas R1 and R2, the clothing 1 has high heat retention. Therefore, by providing the mesh areas R3, R7, and R6 at parts where the body temperature tends to rise, the air permeability can be improved, and both warmth and comfort can be achieved.

The outer fabric 31 has the air hole 17 at the part 18*a* corresponding to the back of the neck of the wearer at the back part where the mesh area R3 is disposed. Accordingly, by releasing the air trapped inside through the air hole 17 to the outside, the circulation of the air can be further promoted.

In the mesh area R3, the batting 30B has a moisture absorption and heat generation function, and the outer fabric 31 has the cover 18*b* capable of opening and closing the air hole 17, the cover 18*b* opens the air hole 17 when the wearer wears the hood 15, and the air hole 17 is closed when the wearer does not wear the hood 15. Thus, when the wearer does not wear the hood 15 (when the weather is not so cold), the air hole 17 is closed by the cover 18*b* and the hood 15, thereby maintaining heat retention capacity.

On the other hand, when the wearer wears the hood 15, since the inside and outside of the clothing 1 communicate with each other through the open air hole 17, air containing moisture from the back part of the wearer is released to the outside through the mesh area R3 and the air hole 17. By releasing the air trapped inside through the air hole 17 to the outside, the circulation of the air can be further promoted.

In the above-described embodiment, the filling material 30 enclosed in the pack P is not limited to down, but may be feather or batting. In addition, the filling material 30 may include a mixture of any two or three of down, feather, and batting.

In the down areas R1 and R2, the upper joining line LA of the first pack PA and the lower joining line LB of the second pack PB may be separate joining lines. By sharing the upper joining line LA of the first pack PA and the lower joining line LB of the second pack PB as in the above-described embodiment, the structure of the down area can be simplified.

By using a ventilation control material as the outer fabric 31 of the clothing 1, for example, according to the humidity inside the clothing 1, the stitches of the fabric are closed to suppress ventilation in a low humidity state, and the stitches are opened to improve air permeability in a high humidity state. As a result, moisture inside the clothing 1 can be easily released to the outside through the mesh areas R3, R7, and R6.

In the above-described embodiment, the back body part 11 has a cotton area R4 in which a cotton material is enclosed in the lower portion 11*b* thereof. Since the cotton material has higher strength than down, for example, even when the lower portion 11*b* of the back body part 11 is stepped on by the buttocks of the wearer every time the wearer of the clothing 1 sits down, it is possible to suppress deterioration of the cold protection function of the clothing 1, and the change in shape of the clothing 1.

In addition, since the cotton material is more resistant to water than down, it is possible to suppress deterioration of the cold protection function and durability of the clothing 1 even when the wearer sits down in a wet place. This configuration is particularly suitable for the clothing 1 for outdoor use, sports such as skiing and skateboarding, and the like.

The side portions 13 have the cotton area R5 over the entirety thereof, and thus the wearer of the clothing 1 can wear the clothing 1 on the body with the side portions tightened and the arms fully closed. Therefore, the silhouette of the wearer of the clothing 1 can be slimmed down.

Since the hood 15 has a cotton area in which a cotton material is enclosed in the main body portion 15*a* including at least the top portion 15*e*, even when the hood 15 gets wet due to rain or snow, it is possible to suppress deterioration of the cold protection function of the hood compared to down.

Since the collar portion 15*b* of the hood 15 has a down area in which down is enclosed, the cold protection and lightness of the hood 15 can be ensured.

The shoulder portion 14 has the mesh area R7 in which the mesh fabric M and the batting 30B are laminated. By disposing the mesh fabric M on the shoulder portion 14, it is possible to improve air permeability in the shoulder where the body temperature tends to rise (likely to perspire). By disposing the batting 30B in the shoulder portion 14, even when the shoulder portion 14 gets wet due to rain or snow, it is possible to suppress deterioration of the cold protection function of the shoulder portion 14 compared to down. In addition, by disposing the batting 30B in the shoulder portion 14, it is possible to suppress deterioration of the cold protection material of the shoulder portion 14 due to the string when carrying a backpack or the like. This configuration is particularly suitable for the clothing 1 for outdoor use, sports such as skiing and skateboarding, and the like.

In the above-described embodiment, the back body part 11 may be free of the mesh area R3 and the cotton area R4, and the entire back body part 11 may be the down area R2 in which a plurality of packs P are disposed in an overlapping manner. In this case, the heat retention and lightness of the clothing 1 can be improved.

In the above-described embodiment, the shoulder portion 14 may have a down area or cotton area instead of the mesh area R3. In addition, both the main body portion 15*a* and the collar portion 15*b* of the hood 15 may be cotton areas or down areas.

Furthermore, the clothing 1 may have the front body part 10 divided into an upper portion and a lower portion, with the down area R1 disposed in the upper portion and the cotton area disposed in the lower portion. The upper portion of the front body part 10 is, for example, a part that covers the chest and abdomen of the wearer of the clothing 1, and the lower portion is a part that covers the lower abdomen of the wearer of the clothing 1.

The clothing 1 in the above-described embodiment may have other shapes. The hood 15 may or may not be present. The clothing 1 in which a plurality of packs P are disposed in an overlapping manner on the same surface to form dead air is not limited to upper clothing such as jacket, coat, parker, inner down jacket, and the like, but may be lower clothing such as pants, or may be a hat, gloves, or the like.

The present application is based on Japanese Patent Application (No. 2020-214028) filed on Dec. 23, 2020, and the content thereof is incorporated herein by reference.

REFERENCE SIGNS LIST

1: Clothing
10: Front body part
11: Back body part
12: Sleeve portion
13: Side portion
14: Shoulder portion
15: Hood
R1: Down area
R2: Down area
R3: Mesh area
R4: Cotton area
R5: Cotton area
R6: Mesh area
R7: Mesh area

The invention claimed is:

1. A clothing, inside which a plurality of packs are disposed, wherein the plurality of packs are disposed on a same surface and disposed to partially overlap each other;

the plurality of packs include: a first pack; and a second pack disposed immediately above the first pack;

the first pack and the second pack each have an outer fabric, an inner fabric, and a filling material;

the filling material is disposed in a space formed between the outer fabric and the inner fabric, which is a space partitioned by a joining line between the outer fabric and the inner fabric;

the second pack is joined to the inner fabric of the first pack in a state where the inner fabric is folded below a side joining line defining the side of the second pack on the same surface;

mesh areas; and a back body part, wherein:

the mesh area is disposed linearly at the back part of the back body part covering the back and waist of the wearer; and an outer fabric of the mesh areas has an air hole at a part of the back part corresponding to a back of a neck of the wearer.

2. The clothing according to claim 1, wherein:

the plurality of packs include: a first pack; and a second pack (PB) disposed immediately above the first pack; and an upper joining line, defining an upper side of the first pack on the same surface, is above a lower end of the second pack.

3. The clothing according to claim 1, wherein:

the plurality of packs include: a first pack; and a second pack disposed immediately above the first pack; and a lower joining line, defining a lower side of the second pack on the same surface, is above a lower end of the second pack (PB).

4. The clothing according to claim 1, wherein the inner fabric of the first pack and the inner fabric of the second pack (PB) are a series of fabrics.

5. The clothing according to claim 1, further comprising:

a hood, wherein:

batting of the mesh areas has a moisture absorption and heat generation function;

the outer fabric has a cover capable of opening and closing the air holes; and the cover opens the air holes when the wearer wears the hood, and closes the air holes when the wearer does not wear the hood.

6. The clothing according to claim 1, wherein a filling material enclosed in the pack is down, feather, or batting.

7. The clothing according to claim 1, wherein:

the clothing is an upper clothing including a front body part, a back body part, sleeve portions, and side portions;

a whole of the front body part, an upper portion of the back body part, and a whole of the sleeve portion are disposed with the plurality of packs in which down is enclosed inside; and a whole of the side portion and the lower portion of the back body part are enclosed with batting in the fabric.

* * * * *